United States Patent [19]

Gill

[11] 3,968,599

[45] July 13, 1976

[54] LENS BLOCKING TOOLS

[75] Inventor: Charles L. Gill, Dresden, N.Y.

[73] Assignees: Harris, Beach & Wilcox; Angelo Pelino, ; part interest to each

[22] Filed: Sept. 17, 1974

[21] Appl. No.: 506,868

Related U.S. Application Data

[62] Division of Ser. No. 311,399, Dec. 1, 1972, Pat. No. 3,866,660.

[52] U.S. Cl. ..... 51/216 LP

[51] Int. Cl.[2] ..... B24B 41/06

[58] Field of Search ..... 51/216 LP, 217 L, 277; 269/7

[56] References Cited

UNITED STATES PATENTS

| | | | |
|---|---|---|---|
| 2,509,211 | 5/1950 | Clement | 51/277 |
| 3,144,992 | 12/1963 | Reardon | 51/216 L X |
| 3,512,310 | 5/1970 | Rudd et al. | 51/277 |
| 3,794,314 | 2/1974 | Coburn et al. | 51/217 L X |

FOREIGN PATENTS OR APPLICATIONS

| | | | |
|---|---|---|---|
| 519,375 | 6/1921 | France | 51/216 LP |
| 383,875 | 11/1923 | Germany | 51/216 LP |

*Primary Examiner*—Harold D. Whitehead
*Attorney, Agent, or Firm*—Shlesinger, Fitzsimmons & Shlesinger

[57] ABSTRACT

Each tool comprises a molded head and a cylindrical shank for supporting the tool in a surfacing machine. In one embodiment the head is semi-spherical in configuration, and a plurality of metal inserts are embedded in the head so that a circular recess, which is formed in one end of each insert to hold a lens blank, opens on the spherical surface of the head with its axis extending through the center of curvature of the head and the axis of the tool shank. In another embodiment the head contains a large semi-spherical recess, and the inserts are embedded in the head so that their recessed ends open on the surface of the spherical recess with the axes of the circular recesses extending through the center of curvature of the spherical recess and the axis of the tool shank. In each embodiment the head is made from a material having a melting point lower than those of the inserts and shanks so that the head can be melted and the inserts and shanks can be retrieved for future use.

7 Claims, 9 Drawing Figures

LENS BLOCKING TOOLS

This is a division of my U.S. application Ser. No. 311,399, filed Dec. 1, 1972 and now U.S. Pat. No. 3,866,660 issued Feb. 18, 1975.

This invention relates to novel blocking tools for accurately supporting a plurality of lens blanks in generating and polishing machines.

In the preparation of certain types of lenses, for example, those employed in cameras and the like, it has been customary to mount or block a plurality of lens blanks on a single tool, which is then used to support the blanks in generating and polishing machines which grind the desired surfaces on the blanks. For grinding convex surfaces the tool usually has thereon a segmental spherical surface in which a plurality of spaced, circular recesses are drilled or otherwise provided so that their axes pass through the center of curvature of the spherical tool surface. Lens blanks are then removably cemented in these recesses so that the surfaces to be ground project above the spherical surface of the tool. The tool is then mounted, for example, successively in generating, grinding and polishing machines, which produce identical convex surfaces on the projecting faces of the blanks.

For producing concave surfaces, a tool is used which has a segmental spherical recess in which a plurality of spaced, circular recesses are drilled or otherwise provided to have their axes extend through the center of the spherical recess. Lens blanks are then cemented in the circular recesses to project at one side above the bottom of the spherical recess; and the tool is then mounted successively in the generating and polishing machines which produce like concave surfaces on the projecting sides of the blanks.

In order properly to orient the circular recesses in tools of the type described above, it is essential that the drills, for example, that are used to form these circular recesses in the spherical tool surfaces, be very accurately positioned so that the axes of all the circular recesses in a given tool will intersect the center of its spherical surface. This assures, as nearly as possible, that the concave or convex surfaces that are ground on the several blanks on a given tool will have the same radius of curvature. The disadvantage of producing tools in this manner, however, is that it is extremely expensive to drill the necessary recesses in the tool bodies; and, moreover, in view of the high cost of preparing the tools, it has become customary for most manufacturers to save them for future use. Over a period of time, therefore, the cost of labor and space for storage of these tools can become prohibitive.

A primary object of this invention is to eliminate the high production and storage costs heretofore associated with blocking tools of the type described. To this end it is an object also to provide an improved blocking tool which is substantially easier to manufacture and store than prior such tools.

A further object of this invention is to provide a novel lens blocking tool having a plurality of lens-supporting metal inserts molded into a low-melting point body portion, which can be remelted after the tool has been used, so that the inserts can be reclaimed and saved for future use, if desired.

It is another object of this invention to provide improved blocking tools of the type used to support lens blanks in generation and polishing machines which grind curved surfaces on the blanks.

A further object of this invention is to provide a molded lens blocking tool having a re-meltable, low-melting point body and a plurality of re-usable, high-melting point, lens-supporting inserts molded into said body and having therein recesses for supporting lens blanks on the tools.

Other objects of the invention will be apparent hereinafter from the specification up to the recital of the appended claims, particularly when read in conjunction with the accompanying drawings. In the drawings:

Figure 1:
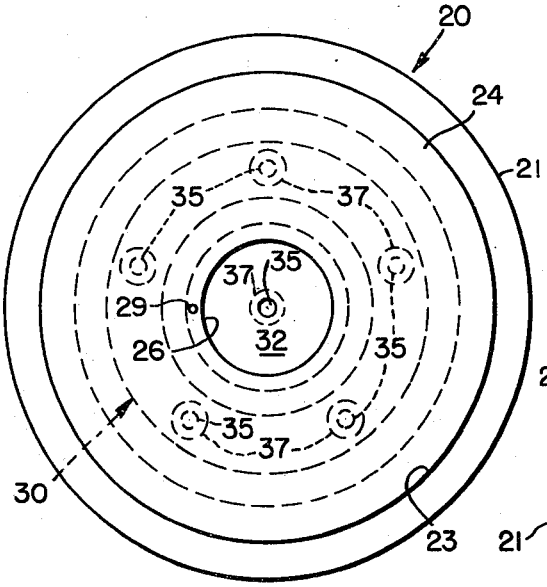
FIG. 1 is a plan view of a mold for making lens blocking tools of the type made in accordance with one embodiment of this invention.
Figure 2:
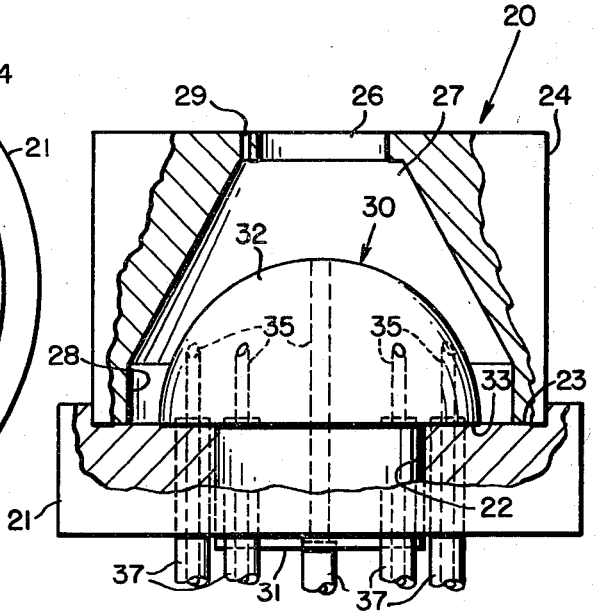
FIG. 2 is a fragmentary elevational view of this mold, with portions thereof broken away and shown in section to illustrate the interior of the mold.

Referring now to the drawings by numerals of reference, and first to the embodiment illustrated in FIGS. 1 to 5, 52 denotes generally a novel tool for holding lens blanks of the type upon which concave surfaces are to be ground. As disclosed in greater detail in my above-noted U.S. application Ser. No. 311,399, this tool may be prepared by apparatus denoted generally at 20, and including a mold comprising an annular base section 21 and a cylindrical cover section 24.

Removably mounted between the mold sections 21 and 24 is a mushroom-shaped plug 30, having a shank 31 which projects through the bore 22 in mold section 21, and an enlarged, semispherically shaped head 32 which projects coaxially into the recess 27 in section 24.

Referring to FIGS. 3 to 5, 40 denotes a generally disc-shaped metal insert having in its periphery a circular groove 41, and on opposite ends thereof circular end faces 42 and 43, which lie in spaced, parallel planes that extend at right angles to the axis of the insert. A circular bore or recess 44 extends coaxially and partway into each insert centrally of its end face 42, and has a tapered or conically shaped inner end 45. A tapered or beveled surface 46 is formed around the outside of the recessed end of each insert 40 coaxially of its end face 42, so that the inner and outer peripheral edges of each surface 42 are disposed coaxially around the associated bore 44. The groove 45, and a plurality of shallow, parallel grooves 47 which are formed in the end surface 43 of each insert, help to secure the inserts against movement in the tool body, which is molded about the inserts as noted hereinafter.

In use, the upper section 24 of mold 20 is removed; and tubes 37 are connected to a vacuum supply through individual valves (not illustrated) selectively to develop suction at the upper ends of the bores 35 in plug 30 where they open on the spherical surface of the plug head 32. The recessed ends of six inserts 40 are then positioned one by one over the upper ends of the bores 35 so that the inner peripheral edge of the surface 42 on each insert engages the curved surface of the head 32 around one of the bores 35. This circular, line contact between each surface 42 and the head 32 causes the recessed end of each insert to be held snugly and sealingly on the head 32 by the vacuum that is developed in the associated bore 35. Moreover, because of this line contact, each insert 40 will automatically position itself on the head 32 so that the axis of its recess 44 and hence that of the insert itself, will pass through the center C (FIG. 3) of the semi-spherically shaped head 32.

Figure 3:
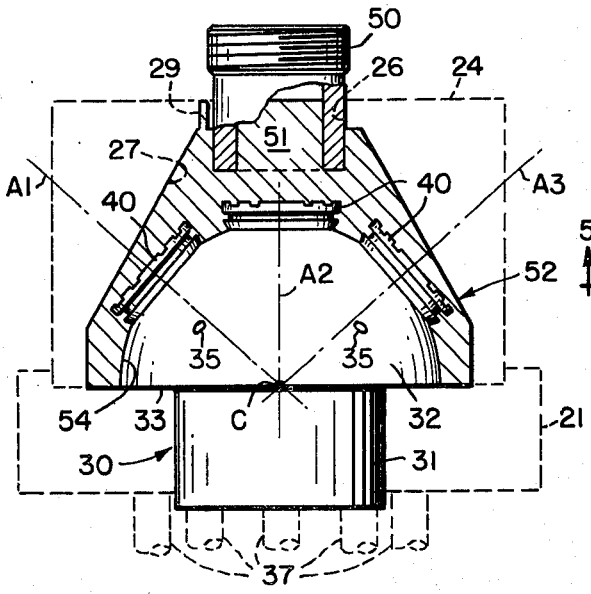
FIG. 3 is a view generally similar to FIG. 2 but illustrating the upper and lower sections of this mold in phantom, and showing, part in section and part in full, the tool prepared by this mold.
Figure 4:
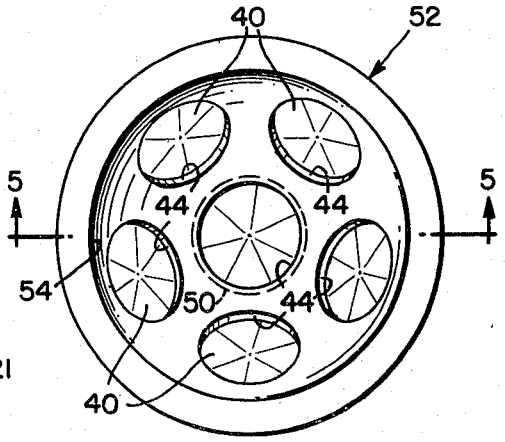
FIG. 4 is a bottom plan view of the molded tool shown in FIG. 3.

In FIG. 3, wherein by way of example only three inserts 40 are illustrated as they would appear upon being held by vacuum over three of the bores 35, it will be noted that the axes A1, A2, and A3 of the three inserts pass through the center C of the head 32. It will be apparent, that since the surface on head 32 is spherical, and since the inner peripheral edge of each surface 42 is disposed coaxially of the recess 44 which it surrounds, it is not necessary that the recessed end of each insert be centered exactly over the center of the upper end of the associated bore 35 in plug 30, it being necessary only that the upper end of the bore 35 open on the recess 44 of the associated insert.

After six inserts 40 have been secured by vacuum over the bores 35 in the head 32, a chucking sleeve 50 is secured intermediate its ends releasably and coaxially in the opening 26 in the upper mold section 24 so that a predetermined part of the sleeve projects above or exteriorly of section 24 to form a chucking shank on the finished tool as noted hereinafter. Thereafter section 24 is repositioned coaxially in the recess 23 in lower section 21, and a molten molding material 51, which has a melting point lower than those of the inserts 40 and the sleeve 50, (for example, an eutectic alloy) is poured through the bore in sleeve 50 to fill the cavity in the assembled mold around the inserts 40, as well as the riser 39 and the lower end of the bore in sleeve 50 to the level illustrated in FIG. 3. The molding material is thereafter allowed to cool and solidify, thus producing the tool 52, having a molded body portion in which the inserts 40 and one end of the sleeve 50 are embedded.

Figure 5:
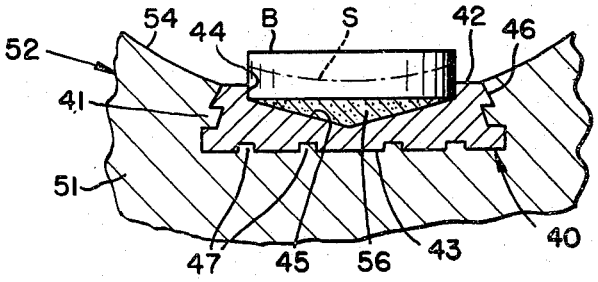
FIG. 5 is an enlarged, fragmentary sectional view taken along the line 5—5 in FIG. 4 looking in the direction of the arrows.

After the alloy 51 has solidified and the mold sections 21 and 24 are separated; and the tool 52 is removed from section 24, thus exposing on one end of the tool a semi-spherical recess 54, and the six recessed ends of the embedded inserts 40, which open on recess 54. Thereafter six circular lens blanks B, only one of which is illustrated in FIG. 5, may be secured by an adhesive 56 in the spaced recesses 44. Each blank B has a diameter only slightly less than that of the recess 44 in which it is secured, so that the blank automatically centers itself coaxially of the recess.

After the lens blanks have been blocked or mounted in the tool 52, the latter is chucked by means of the projecting end of sleeve 50 in, for example, a conventional lens generating or surfacing machine. Each blocked blank B is positioned coaxially of its associated recess 44, and since the axis of each such recess extends through the center C of the semi-spherical recess 54 that was formed by the head 32 coaxially of sleeve 50, the radii of curvature of the concave surfaces S (FIG. 5), which are ground on the blanks B during the generating operation, will also pass through the center C so that identical surfaces will be ground thereon.

Subsequent to the generation and polishing of the surfaces S on the lens blanks the adhesive 56, which may be of a variety having a melting point lower than the material from which the tool body was molded, may be heated to permit removal and replacement of the blanks B with other lens blanks to have their surfaces ground as noted above; or, if there is no further immediate need for using tool 52, its body represented by the blocking alloy 51 may be remelted, leaving its six inserts 40 which then may be stored together with the associated mold 20, for future use.

Referring now to the modification illustrated in FIGS. 6 to 9, wherein like numerals are employed to denote elements similar to those employed in the first embodiment, 80 denotes a tool suitable for use in grinding convex surfaces on lenses. It may be produced by molding apparatus 60 comprising an upper mold section 61, a lower mold section 62, and a plug 73 having a shank 72 threaded into a bore 71 in mold section 61, and an enlarged, semi-spherically shaped head 74, which projects into the recess 65 in mold section 62. A shoulder 75, which is formed on the plug 73 between its shank 72 and its head 74, engages the bottom of recess 63 in section 61 to maintain head 74 in slightly spaced relation to the bottom of recess 63, and assures that each shank 72 will always have the same relative position for all tools made in mold 60. Four shallow grooves or notches 77 are formed in the surface of head 74 at 90° intervals about its axis for improving the bond between head 74 and the molding material which is disposed thereabout as noted hereinafter.

Figure 9:
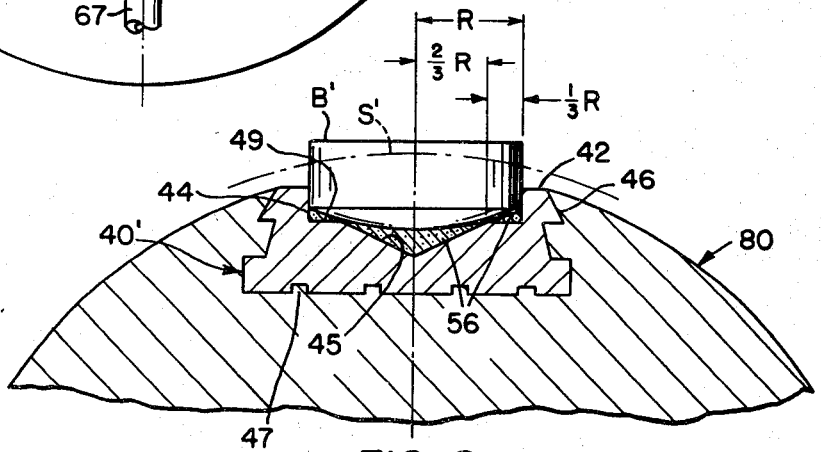
FIG. 9 is an enlarged, fragmentary sectional view taken centrally through the upper end of the blocking tool shown in FIG. 8, and illustrating a modified form of insert that may be employed in the tool.

FIG. 9 illustrates in section a slightly modified insert 40′, several of which may be employed with mold 60 in lieu of the type of insert 40 described above. The modified insert 40′ is similar to the insert 40, except that it has a flat, circumferential shoulder 49 formed at the bottom of recess 44 between the annular wall portion of the recess and its conical bottom 45. The radius of the conical bottom 45, where it intersects the shoulder 49, is two thirds of the radius R of the circular recess 44.

In use, the upper mold section 61 together with the plug 73 are removed from the bottom section 62; and tubes 67, which are attached to bores 66 in section 62, are connected to a vacuum supply to develop suction at the inner ends of the bores 66. The recessed ends of six inserts 40′ are then positioned over the inner ends of the bores 66, as illustrated for example by the single insert 40′ shown in FIG. 6, so that the outer peripheral edge of the surface 42 around the recess 44 in each insert seats sealing with line contact against surface 65 to be held thereagainst by the suction generated in the associated bore 66, and whereby the axis of each insert 40′ will automatically be aligned with the center C′ of the mold recess 65.

Figure 6:
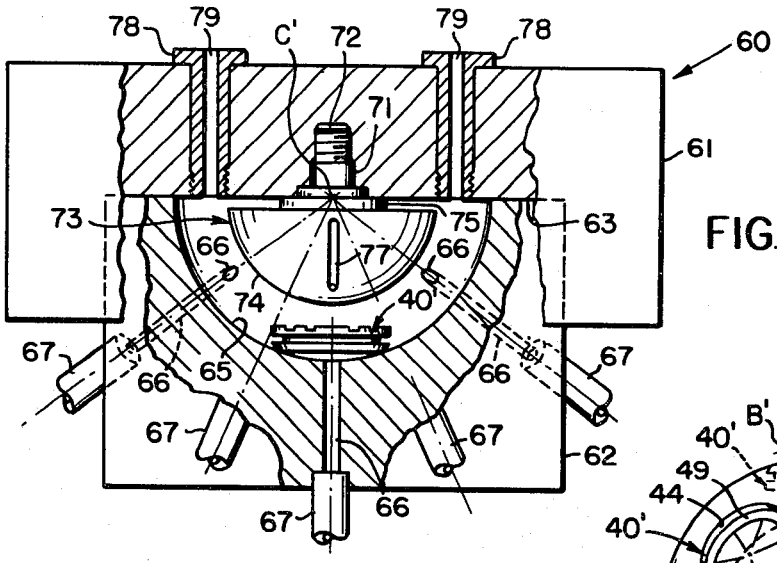
FIG. 6 is an elevational view of a modified mold, which is used to prepare a lens-blocking tool made in accordance with another embodiment of this invention, portions of this mold being broken away and shown in section for purposes of illustration.
Figure 8:
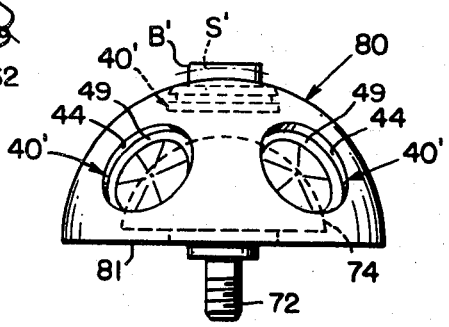
FIG. 8 is an elevational view of a lens blocking tool made by this modified mold.
Figure 7:
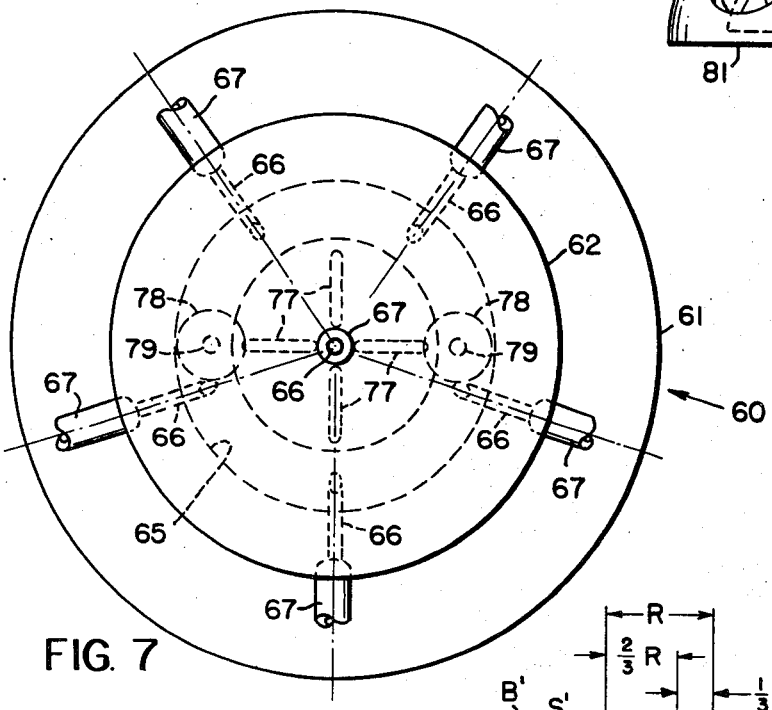
FIG. 7 is a fragmentary, bottom plan view of this modified mold.

The upper mold section 61 together with the plug 73 are then repositioned over the lower mold section 62 as shown in FIG. 6; and a molten molding material is poured through the bore 79 in one of the bolts 78 to fill the cavity between the mold sections, and around the inserts 40 and the head 74 of plug 73.

After the mold 60 has been allowed to cool to solidify the molding material, the upper mold section 61 is again removed from section 62, thereby withdrawing from recess 65 the completed tool 80 (FIGS. 8 and 9) containing six inserts 40', and the head 74 of plug 73. At this time the shank 72 of the plug is still threaded into section 61, and portions of the molding material have solidified in the bores 79 of the bolts 78. These bolts are therefore removed from the section 61 to shear the solidified molding material in their bores 79 from the plane underside 81 (FIG. 8) of the tool, after which tool 80 can be removed from section 61 merely by rotating the entire tool in a direction to unthread the shank 72 of the now-embedded plug 73 from the bore 71 in section 61.

After tool 80 has been removed from the mold 60, lens blanks may be secured as in the first embodiment by adhesive 56 in the recesses 44 of the six inserts 40' that are now embedded in the tool. By way of example, a single, semi-finished lens blank B' is shown secured in an insert 40' in FIGS. 8 and 9 with its finished side supported on the inner peripheral edge of the shoulder 49. When six such blanks have been secured in the tool recesses 44, the threaded shank 72 which is now an integral part of the tool, is used to mount the tool successively in generating, fine grinding, and polishing machines of the type described above. These operations will produce on the upper or outer ends of each blank B' identical convex surfaces of the type shown by broken lines at S' in FIGS. 8 and 9. Also as in the first embodiment, when the tool 80 is no longer needed, its body may be remelted leaving the inserts 40' and the plug 73, which together with the mold 60 may be stored for future use. When a plurality of tools are made from mold 60, the shoulder 75 on plug 73 will assure proper axial positioning of the chucking shank relative to the molded tool body.

The plug 73 is made from a material which has a melting point higher than that of the molding material which is used to mold the tool body. Moreover, since the shank 72 is used to chuck the tool 80 in the surfacing machines, it is essential that it be made from a hardened steel to minimize wear. For economy, therefore, it may be desirable to make the shank from a material different from that of the head 74, in which case the shank may be threaded or otherwise secured at one end in an axial blind bore (not illustrated in the bottom of head 74 to project therefrom as shown in FIG. 6.

Although two different types of inserts 40 and 40' have been disclosed, it will be apparent that either type of insert may be employed with either of the molds 20 and 60. The advantage of the insert 40' is that when a semi-finished blank is blocked thereon for grinding, its finished side is supported by line contact two thirds of the radial distance from its centerline so that any undesirable flexing of the lens during grinding is minimized.

From the foregoing it will be apparent that the instant invention provides a relatively simple and inexpensive tool for blocking lenses of the type described prior to the grinding of convex or concave surfaces thereon. The use of molded tools with retrievable inserts and reusable chucking shanks, obviates the need for the expensive machining stages that were heretofore required to provide properly oriented recesses and chucking surfaces in the tools. These novel tools, moreover, are substantially more inexpensive than prior such tools; and, since the chuck shanks and inserts 40, 40' are retrievable after use, merely by melting down the tool bodies, the method and apparatus disclosed herein enable a substantial reduction in the storage facilities heretofore required for such tools. Also, upon being blocked, the blanks fit snugly in the associated recesses 44 in the inserts to prevent undesirable wedging of a blank during finishing, a fault which is very prevalent in grinding operations which rely upon known blocking processes. Elimination of wedging, furthermore, obviates the centering operations that were heretofore required to correct lenses that were improperly ground because of wedging.

To reduce wedging to a minimum it may be desirable to employ pre-rounded, flat glass lens blanks ground to accurate diameters, thereby assuring a snug fit of the blanks in the recesses 44. The additional cost of such blanks will be more than offset by the savings afforded by use of the molded tool disclosed herein. For even further accuracy, the inserts 40 and 40' may be manufactured from a metal having a coefficient of thermal expansion equal to that of the glass lens blanks that are to be blocked thereon, so that when heat is applied to the tool, for example to melt the adhesive which retains the blanks in the tool, both the blanks and the inserts will expand and contract in unison, so that a blank will not become physically strained in a recess 44 during blocking.

It is to be understood that it is not necessary to manufacture the inserts 40 and 40' from metal. For example, the inserts could be made from a plastic, or from a molded ceramic material having a coefficient of thermal expansion approximately equal to that of the lens blanks blocked on the tools. Moreover, it will be apparent that the tool surfaces formed by the head 32 on plug 30 and the recess 65 in section 62 may be other than semi-spherical in configuration without departing from this invention, provided, however, that each of these surfaces form at least part of a sphere, the center of which lies on the axis of the associated chucking shank 50 or 72.

While only certain embodiments of the invention have been disclosed in detail herein, this application is intended to cover any further modifications which may be readily apparent to one skilled in the art, or which fall within the scope of the appended claims.

Having thus described my invention, what I claim is:

1. A tool for accurately holding a plurality of lens blanks for simultaneous generation thereof on a surfacing machine or the like, comprising a molded body having on one end a segmental spherical surface, a plurality of spaced inserts substantially completely embedded at their inner ends in said body so that only the outer ends of the inserts extend to the exterior of said body and register with said spherical surface, each of said inserts having in its outer end a circular recess opening on said spherical surface with the axis of the recess extending through the center of curvature of said surface, and with said recess in each insert being disposed to have a lens blank adhered therein for a surfacing operation, and a shank projecting from the opposite end of said body coaxially of said surface for mounting the tool in a lens surfacing machine, said body of the tool being molded from a material having a melting point lower than the material from which said inserts are made, whereby after use the body of the tool may be melted and the inserts may be recovered and saved for future use.

2. A tool as defined in claim 1, wherein each insert is circular in cross section and has said circular recess extending coaxially and part way into said outer end thereof, and each insert has on said outer end thereof a circular surface disposed in a plane extending at right angles to the insert axis, and surrounding said recess in the insert coaxially thereof.

3. A tool as defined in claim 1, wherein portions of said molded body project into recesses formed in the outer surfaces of said inserts intermediate their ends, whereby said projecting portions of said body secure the inserts against removal from said molded body.

4. A tool as defined in claim 2, wherein said circular recess has a conically shaped inner end, and a circumferential shoulder is formed on each insert intermediate the ends of its circular recess to engage and support the convexedly shaped surface of a lens blank along a circular path disposed coaxially of said recess, and having a radius equal to two thirds of the radius of said recess.

5. A tool as defined in claim 1, wherein said shank is part of a mounting element, the remainder of which is embedded in the body of said tool, and said shank is made from a material which is substantially harder, and which has a higher melting point, than the material from which said body of the tool is molded.

6. A tool as defined in claim 1, wherein the axes of the circular recesses in said inserts intersect the axis of said shank.

7. A tool for accurately holding a plurality of lens blanks for simultaneous generation thereof on a surfacing machine or the like, comprising a body having on one end a segmental spherical surface, a plurality of spaced inserts substantially completely embedded in said body, so as to be removable therefrom only by destruction of the body, each of said inserts having an inner end completely enclosed within said body, and having an outer end registering with said surface and containing a circular bore which opens on said spherical surface, and in which a lens blank is adapted to be secured for a surfacing operation, and each of said inserts having the axis of its circular recess extending through the center of curvature of said spherical surface, and a cylindrical shank projecting from the opposite end of said body for use in mounting said body in a lens surfacing machine or the like, and having an axis extending through said center of curvature coaxially of said spherical surface, said body being made from a material having a lower melting point than those of said inserts and said shank, whereby said inserts may be removed by heating said body until it melts and releases said inserts.

* * * * *